US011510480B2

(12) United States Patent
Limongi

(10) Patent No.: US 11,510,480 B2
(45) Date of Patent: Nov. 29, 2022

(54) APPLICATION OF COSMETIC PRODUCT, SUCH AS MASCARA

(71) Applicant: Texen, Brion (FR)

(72) Inventor: Michel Limongi, Clichy (FR)

(73) Assignee: Texen, Brion (FR)

( * ) Notice: Subject to any disclaimer, the term of this patent is extended or adjusted under 35 U.S.C. 154(b) by 677 days.

(21) Appl. No.: 16/472,647

(22) PCT Filed: Oct. 17, 2017

(86) PCT No.: PCT/FR2017/052849
§ 371 (c)(1),
(2) Date: Jun. 21, 2019

(87) PCT Pub. No.: WO2018/115605
PCT Pub. Date: Jun. 28, 2018

(65) Prior Publication Data

US 2019/0357659 A1 Nov. 28, 2019

(30) Foreign Application Priority Data

Dec. 22, 2016 (FR) ..... 1663269

(51) Int. Cl.
*A46B 11/00* (2006.01)
*A45D 40/26* (2006.01)
(Continued)

(52) U.S. Cl.
CPC ..... *A45D 40/267* (2013.01); *A45D 40/262* (2013.01); *A45D 40/264* (2013.01);
(Continued)

(58) Field of Classification Search
CPC .. A45D 40/262; A45D 40/264; A45D 40/265; A45D 40/267; A46B 5/0033; A46B 5/0075; A46B 7/023; A46B 2200/1053
See application file for complete search history.

(56) References Cited

U.S. PATENT DOCUMENTS 4,165,755 A 8/1979 Cassai
4,428,388 A 1/1984 Cassai et al.
(Continued)

FOREIGN PATENT DOCUMENTS

EP 2 789 259 A1 10/2014
JP S 60-70215 5/1985
(Continued)

*Primary Examiner* — Jennifer C Chiang
(74) *Attorney, Agent, or Firm* — Blank Rome LLP

(57) ABSTRACT

A device for applying a cosmetic product. The device includes a handling cap for holding, moving and maneuvering the device. The device also includes a rod portion having a first end associated with the handling cap and a second end section having a second end portion that terminates the device. The device further includes an application portion extending along a main axis and having a support member with two ends and radial application members. The application portion is hingedly mounted in an articulation zone by, for example, a rack and toothed wheel on a second end portion of the rod portion and about a pivot axis. The application portion can thereby be pivoted between a centered position and an inclined position. The articulation zone, rack and toothed wheel and the pivot axis may be spaced apart in a median section of the support member.

16 Claims, 16 Drawing Sheets

(51) Int. Cl.
*A46B 5/00* (2006.01)
*A46B 7/02* (2006.01)

(52) U.S. Cl.
CPC ..... *A45D 40/265* (2013.01); *A46B 5/0033* (2013.01); *A46B 5/0075* (2013.01); *A46B 7/023* (2013.01); *A45D 2200/10* (2013.01); *A46B 2200/1053* (2013.01)

(56) References Cited

U.S. PATENT DOCUMENTS

| | | | | |
|---|---|---|---|---|
| 5,188,131 | A | 2/1993 | Toll | |
| 6,505,632 | B1 | 1/2003 | Toll et al. | |
| 8,783,989 | B2 | 7/2014 | Weigel et al. | |
| 9,339,098 | B2 * | 5/2016 | Takata | A45D 40/265 |
| 10,398,215 | B2 * | 9/2019 | Kim | A46B 9/021 |
| 2011/0176856 | A1 | 7/2011 | Gardner et al. | |
| 2014/0016984 | A1 | 1/2014 | Kim | |

FOREIGN PATENT DOCUMENTS

| | | | |
|---|---|---|---|
| JP | S 6070216 | U | 5/1985 |
| JP | 2005-237395 | A | 9/2005 |
| WO | WO 2015/124550 | A2 | 8/2015 |

* cited by examiner

APPLICATION OF COSMETIC PRODUCT, SUCH AS MASCARA

CROSS-REFERENCE TO RELATED APPLICATIONS

This application is a national stage of International Application No. PCT/FR2017/052849, filed on Oct. 17, 2017, which claims the benefit of French Patent Application No. 1663269, filed on Dec. 22, 2016, the contents of each of which are incorporated by reference herein.

The invention relates to the application of a cosmetic product, such as mascara, more precisely a device for applying such a product (referred to by ellipsis as the "application device") onto keratin fibres (eyelashes, eyebrows), an assembly comprising such an application device and a reservoir for cosmetic product and the method of applying such an assembly and more especially the application device.

An assembly comprising a mascara reservoir and a mascara application device, provided with one opening in which a wiper is mounted and through which the application device passes during its introduction, extraction and loading with mascara. The design of the reservoir and the application device are mutually adapted. In a known standard, the reservoir is a tube and the assembly is called by ellipsis, a "mascara tube".

JP S60 70216 U describes such an application device comprising:

- a handling cap suitable and intended to close the reservoir and a means for holding, moving and manoeuvring the application device,
- an elongated rod portion, having a main direction, a first end where it is associated with the handling cap and a second end portion including a second end portion that terminates it,
- an elongated mascara application portion extending along a main axis, comprising a support member having two ends, provided at its periphery with radial application members—such as hairs, tips, fibres, spongy elements—hingedly mounted in an articulation zone and by articulation means on the rod portion at its second end portion, about a pivot axis orthogonal to a main radial pivot plane defined by the axis of the application portion and the direction of the rod portion, so that it can occupy a centred position and an extreme inclined position in which said axis and said direction are inclined with respect to each other at most, and to be pivoted from one to the other of these two positions, by means of a pivot stroke,
- the articulation zone, the articulation means and the pivot axis being located in the median section of the support member, spaced from both ends.

According to JP S60 70216 U, the application portion is in one part, the support member is a single-piece, the application members can only be located on a part of the radial periphery of the support member, both ends of which are exposed and protrude from the outer shell of the application members, which is a source of injury, the support member not being entirely included in the outer shell of the application members.

JP S60 70216 U describes a device with aggravated disadvantages and a rack-and-pinion travel control system. The articulation area, the articulation means and the pivot axis are located at a first articulation end of the support member which is completely outside the outer shell of the application members and even spaced therefrom, so that the articulation end of the application portion is unusable for mascara application and even annoying, being exposed and prominent, it is hurtful to the user and may become clogged.

The application of mascara involves constraints and requirements that are ergonomic conditions. The application must be made with gentleness, delicacy, precision, in a similar way for both eyes, and it must not be hurtful. When the user applies mascara himself/herself, it is often difficult for him/her to adopt the ideal hand gestures, as his/her vision is affected by the presence of his/her own hand and it is difficult to adapt the gestures to the side where the eye is located. In addition to the ergonomic conditions of application, there are ergonomic conditions for introduction, extraction and loading. This means that the introduction of the application portion through the opening of the reservoir can be done intuitively, easily, quickly and correctly and that the application members are correctly loaded with mascara.

The invention relates to other products than cosmetics, if the ergonomic conditions are identical or similar to those of mascara, the terms "cosmetic product" and "mascara" being understood as including equivalent products with regard to ergonomic conditions.

In a standard embodiment, the application portion is rigidly attached to the rod portion by extending it. In U.S. Pat. No. 5,188,131, the application portion is rigidly mounted in a rigid association zone on the rod portion transversely. In U.S. Pat. No. 6,505,632, the application portion is fixedly mounted in its center on the rod portion. In JP 2005/237395, the application portion is fixedly mounted at one end on the rod portion. In EP 2 789 259, U.S. Pat. No. 4,165,755, WO 2015/124550 and US 2014/0016984, the application portion is in a single straight section and in U.S. Pat. No. 8,783,989 it is in two rigid straight sections.

Thus, there is a need to have, for mascara or products equivalent in terms of ergonomic conditions, an application device and an assembly also comprising a reservoir, which have the ergonomic characteristics likely to satisfy the ergonomic conditions of application and the ergonomic introduction, extraction and loading conditions previously exposed. This need must be met under acceptable manufacturing conditions and at acceptable prices. This is the problem whereon the invention is based.

A disclosure of the invention as characterized shall be exposed below.

According to a first aspect, the invention relates to a device for applying a cosmetic product, such as mascara, or another product equivalent in terms of ergonomics, suitable and intended to be associated with a mascara reservoir, of the type described above, in which:

- the application portion consists of two adjacent similar application sub-portions arranged opposite each other relative to the pivot plane,
- the support member is formed by two similar support sub-members, arranged opposite and close to each other relative to the pivot plane with interposition between them of the second end portion of the rod portion and the articulation means.

According to one embodiment, the application portion comprises a first section between the pivot axis and a first end and a second section between the pivot axis and a second end, the first section and the second section being mutually extended, the second end portion of the rod portion being located between the two sections.

According to one embodiment, in a centered position, the first distal section is arranged in the axial extension of the rod portion, beyond its second end portion, while the second proximal section is located at the level of the second end section of the rod portion. And, in an extreme inclined position, the first and second sections extend transversely on either side of the rod portion respectively.

According to one embodiment, both ends of the support member are included in the outer shell of the application members and undiscovered and prominent, the application members extending axially beyond each of these two ends, and the support member is entirely included in this outer shell, more particularly is entirely spaced inwardly from the outer shell of the application members.

Possibly, this outer shell has an ellipsoidal shape elongated in the axis of the application portion, as an ovoid assembly shape with on one side a part with a larger radius of curvature and on the opposite side a part with a smaller radius of curvature. Possibly, the part with the larger radius of curvature belongs to the first, distal section of the application portion and the part with the smaller radius of curvature belongs to the second, proximal section of the application portion.

According to one embodiment, the application portion is formed by two application sub-portions which are arranged symmetrically with respect to the pivot plane and which occupy the same relative angular position and rotate in synchronism, and the support member is formed by two support sub-portions which are arranged symmetrically with respect to the pivot plane and which occupy the same relative angular position and rotate in synchronism.

According to one embodiment, the application device includes two subsets of application devices, for the two support members, the arrangement of which provides outward continuity between the two subsets of application devices.

Possibly, each of the two application sub-portions and each of the two support sub-members has a shape of a half ellipsoidal assembly cut in the direction of the major axis, more particularly a semi-oval assembly shape with on one side a part with a larger radius of curvature and on the opposite side a part with a smaller radius of curvature. In the centred position, the respective portions of the two sub-assemblies of the application members towards the part with a larger radius of curvature are intertwined.

Each of the two application sub-portions is limited on the side of the second end portion of the rod portion by a generally flat shell face extending in the general direction of the pivot plane and in the vicinity of this plane. And each of the two support sub-members is limited on this second end portion side by a generally flat shell face that extends in the general direction of the pivot plane, near this plane, and which is adjacent to this second end portion. Possibly, the two faces limiting the two application sub-portions and the two support sub-portions towards this second end portion are spaced from each other in the direction of the pivot axis of the application portion.

In the centred position, the two application sub-portions of the first distal section are adjacent to each other, and the two application sub-portions of the proximal second section are spaced from each other with the interposition of said second terminal section. In an extreme inclined position, the two application sub-portions are adjacent.

The articulation means are arranged so that when the application portion is pivoted, the two application sub-portions move away for the first distal section and closer for the second proximal section.

Possibly, each of the two support sub-members is rigid and the support element, respectively each of the two support sub-members, has a straight axis.

Possibly, the articulation zone, the articulation means and the pivot axis are located in a central position on the support member, being spaced from each other at both ends either by the same or different distances, with a section of shorter length on one side and a section of longer length on the other.

According to one embodiment, the articulation means comprise a rack arranged on the second end portion of the rod portion and extending in the direction of the rod portion and a toothed wheel cooperating with the rack, pivoted by the support member, the toothed wheel and the rack being in permanent engagement. The application device may include and incorporate means to control the pivoting of the application portion, such as locking, braking or friction means.

According to one embodiment, the means for controlling the pivoting of the application portion comprise a rod arranged in a recess in the rod portion and arranged so as to be slidable in the direction of the rod portion, in both directions, ridgedly associated by its second end with the end of the rack, and a control knob attached to a first end of the rod, arranged so as to be accessible from the outside through a hole of the side skirt of the handling cap, elongated so that the control knob can slide in the hole.

According to a second aspect, the invention relates to an assembly comprising a reservoir provided with an opening, suitable and intended to receive cosmetic products, such as mascara, or another product equivalent with regard to ergonomic conditions, and an application device suitable to be associated with or dissociated from the reservoir, as just described.

According to a third aspect, the purpose of the invention is a method for implementing such an assembly, starting from a state in which the application device is dissociated from the reservoir, and handling the application device with the handling cap, which consists in:

- bringing the application device into the centred position if it is not already centred,
- introducing into the reservoir, through the opening thereof, at least the application portion of the application device in the centred position, and loading it with mascara,
- extracting from the reservoir, through its opening, the part of the application loaded with mascara,
- bringing the application device into an inclined position suitable for the application,
- applying the application members onto keratin fibres (eyelashes, eyebrows).

The Figures are Now Briefly Described.

Figure 1:
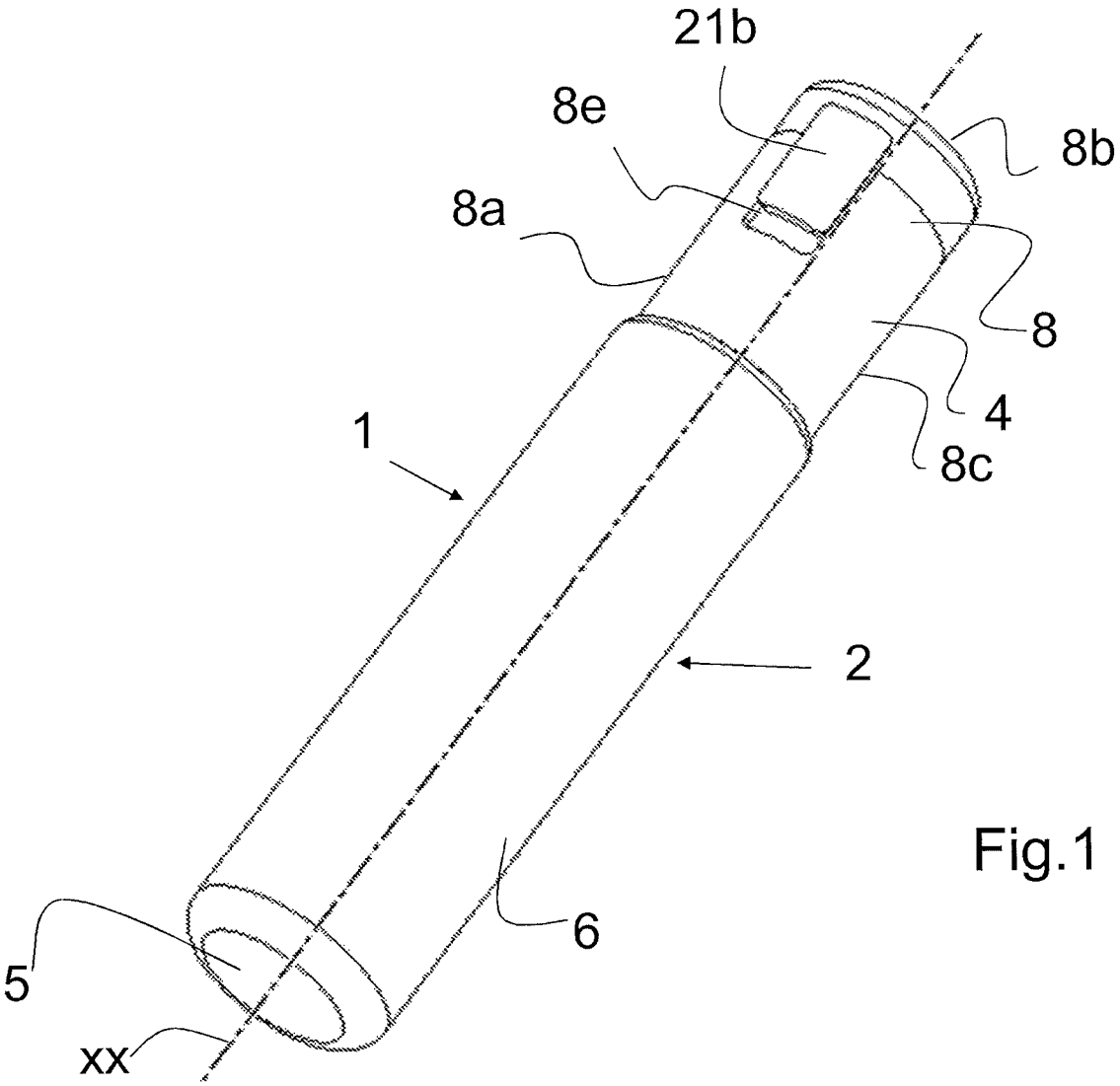
FIG. 1 is a perspective view of an assembly comprising a reservoir and an application device associated with the reservoir with a handling cap visible that has a hole in its side skirt.
Figure 8:
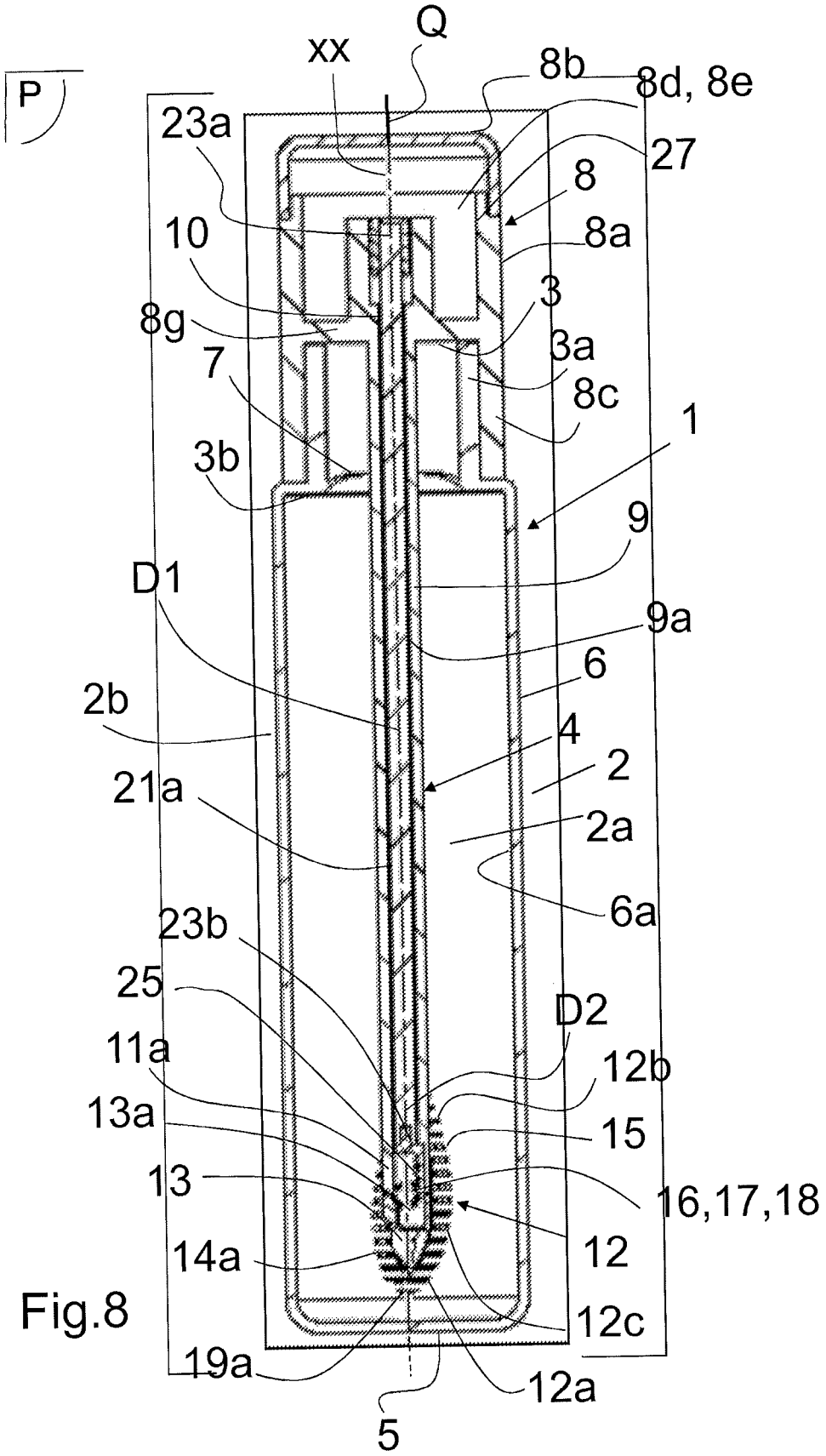
Figure 9:
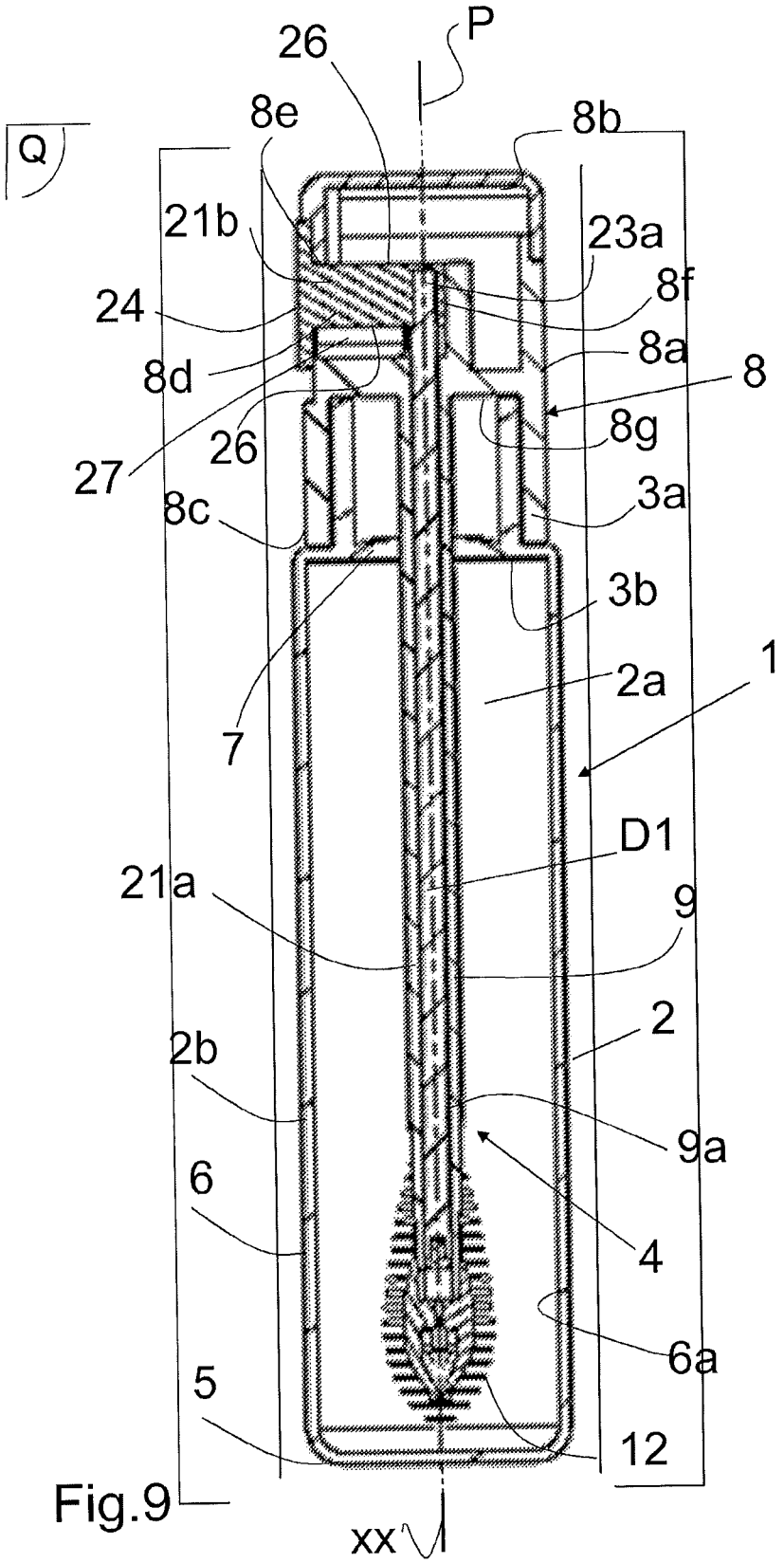

FIGS. 8 and 9 are two axial cross-sectional views of the assembly shown in FIG. 1, respectively in a main radial pivot plane and in a plane orthogonal to the previous one called the travel reference plane; these figures illustrate that the outer shell of the application members has an ovoid ellipsoidal assembly shape with on one side a part with a larger radius of curvature and on the opposite side a part with a smaller radius of curvature, the part with a larger radius of curvature belonging to the first, distal section of the application portion and the part with a smaller radius of curvature belonging to its second, proximal section.

Figure 10:
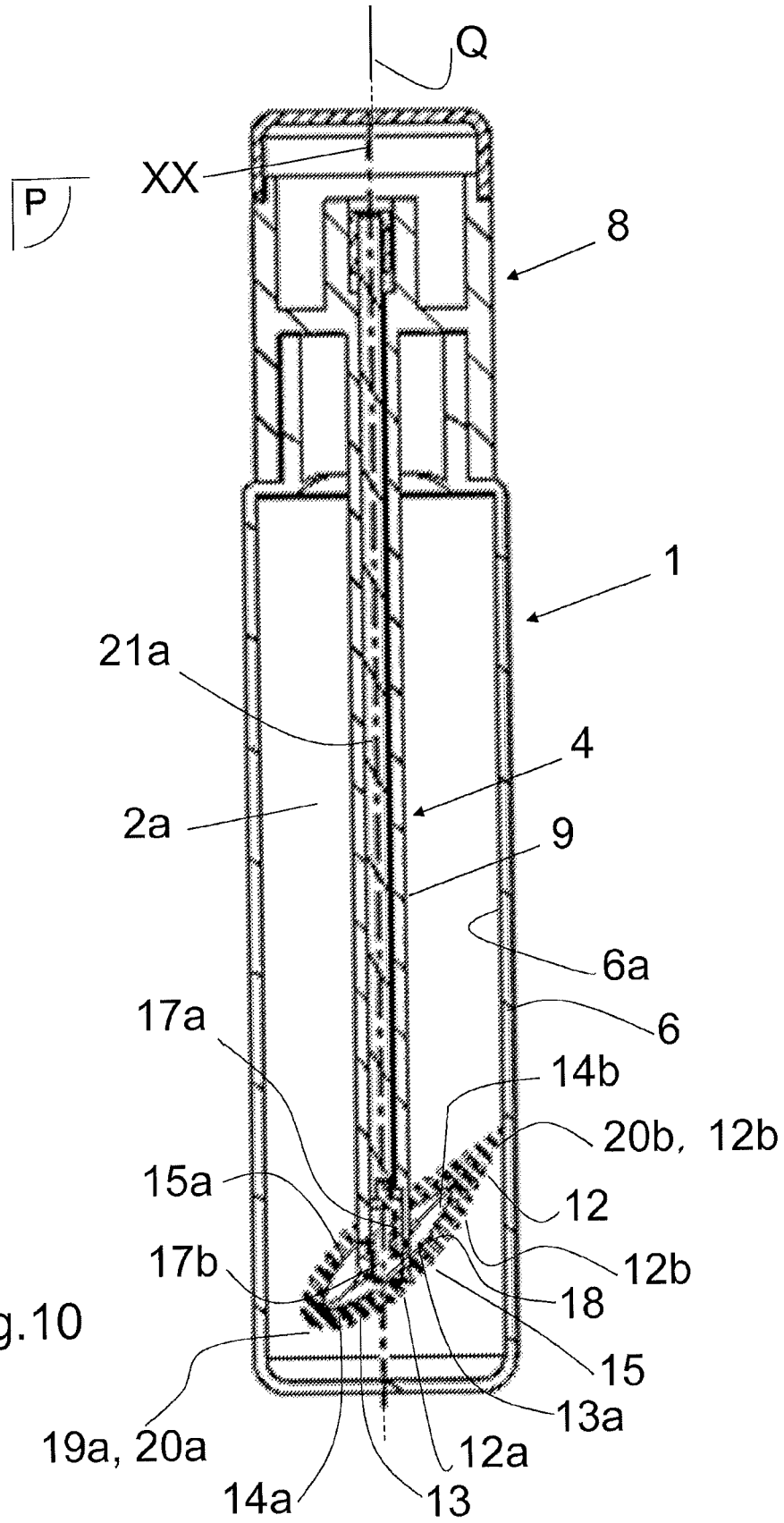

FIG. 10 is an axial cross-sectional view similar to FIG. 8, in which the axis of the application portion and the direction of the rod portion are inclined relative to each other.

Figure 2:
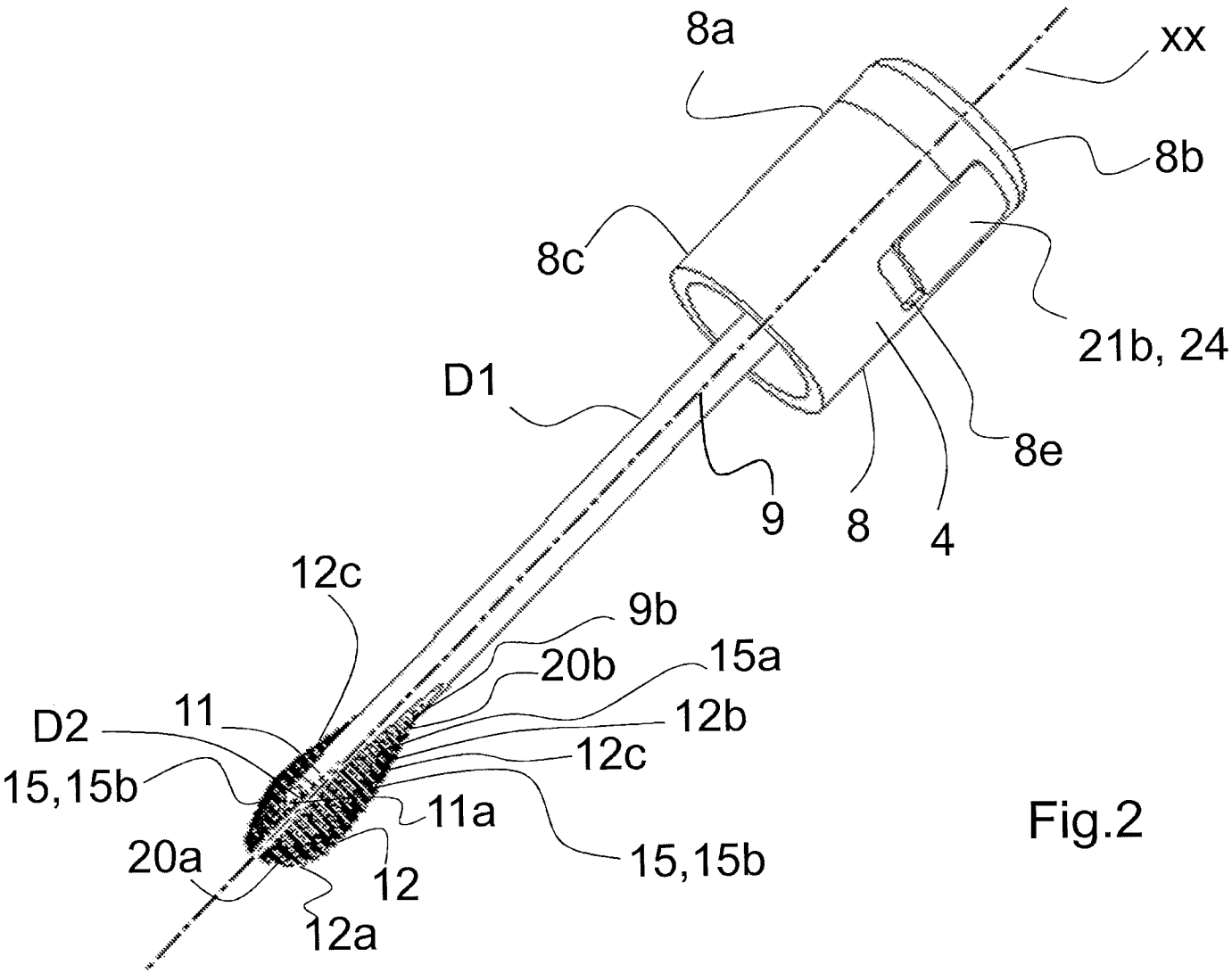
FIG. 2 is a perspective view of the application device of the entire FIG. 1, in which the support member is centered.
Figure 3:
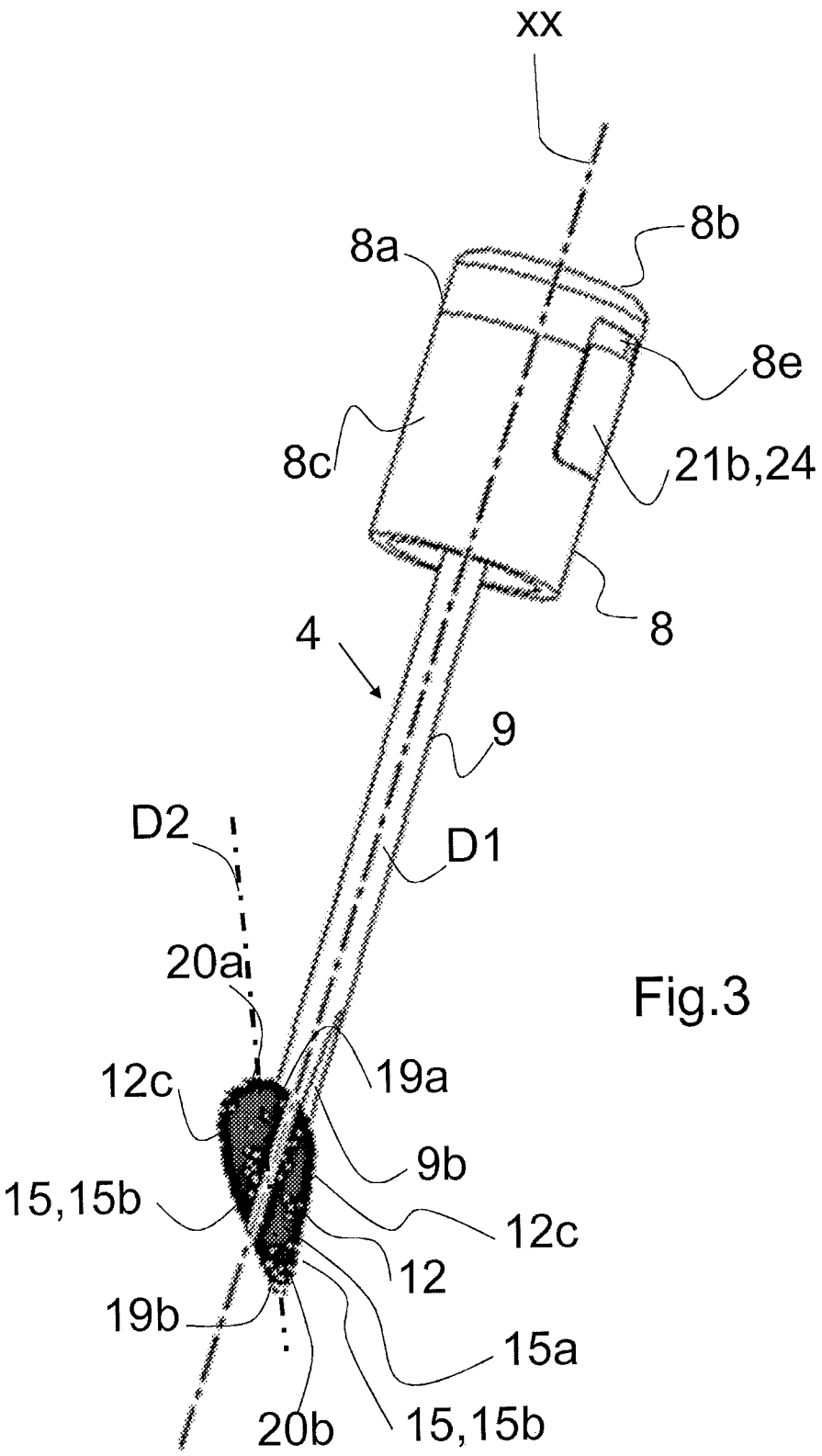
FIG. 3 is a perspective view of the application device of FIG. 2, shown in an intermediate inclined position.
Figure 4:
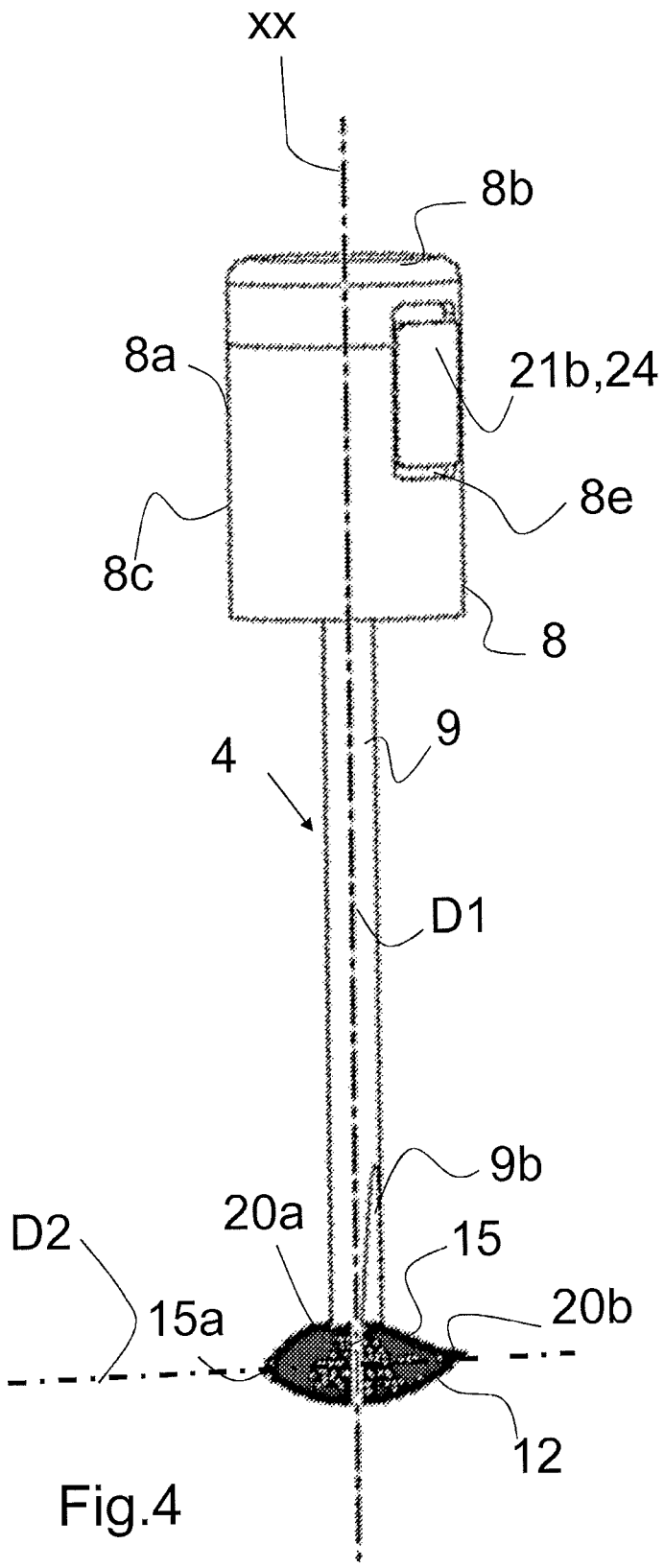
FIG. 4 is a perspective view of the application device in FIGS. 2 and 3, which is in an extreme inclined position at about 90°.
Figure 11:
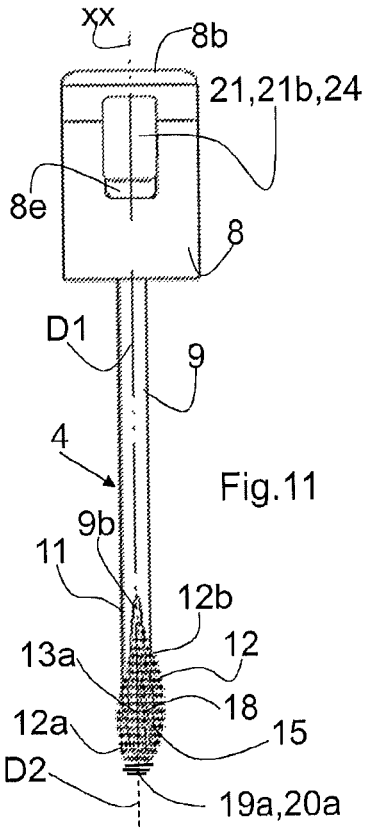

FIG. 11 is an elevation view of the application device in a plane parallel to the pivot plane, located in the centred position shown in FIG. 2.

Figure 12:
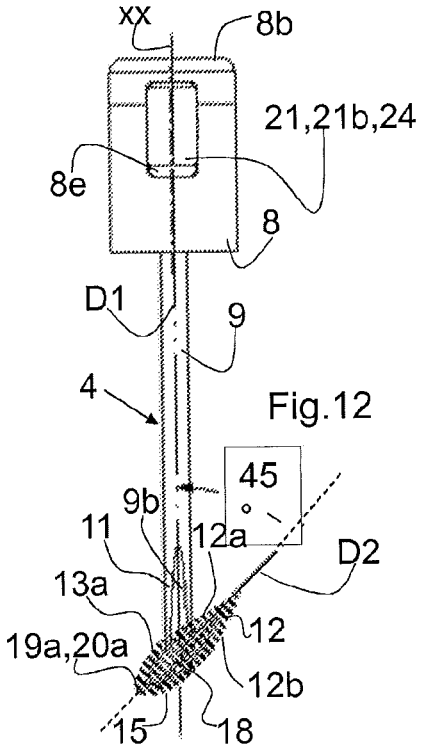
Figure 13:
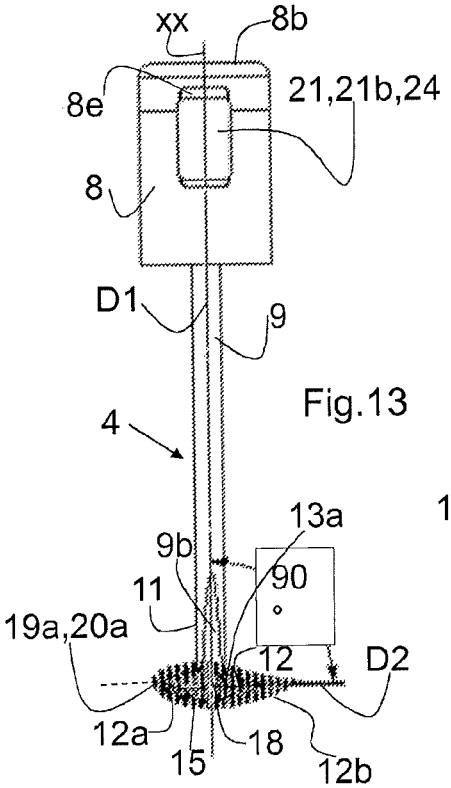
Figure 14:
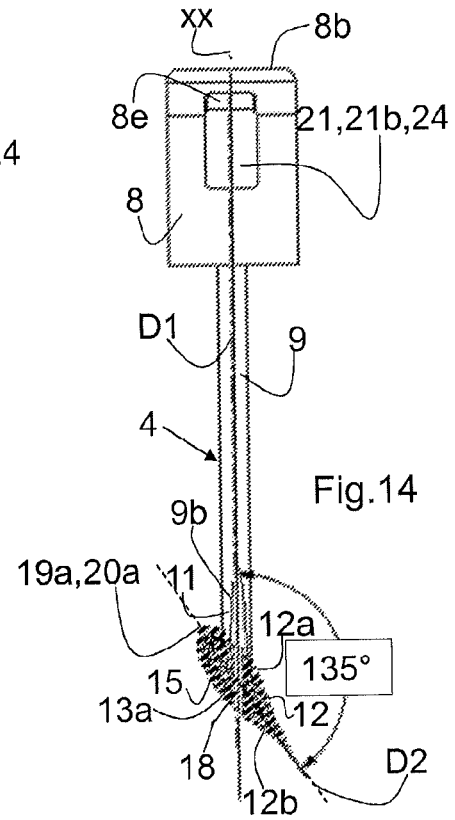

FIGS. 12, 13 and 14 are three elevation views of the application device in intermediate (FIGS. 12 and 13) and extreme (FIG. 14) inclined positions; these figures illustrate that the two ends of the support member are included in the outer shell of the application members and undiscovered and prominent, the application members extending axially beyond each of these two ends, the support member, including its two ends, being entirely included in the outer shell of the application members, and even entirely spaced towards the inside of this shell.

Figure 15:
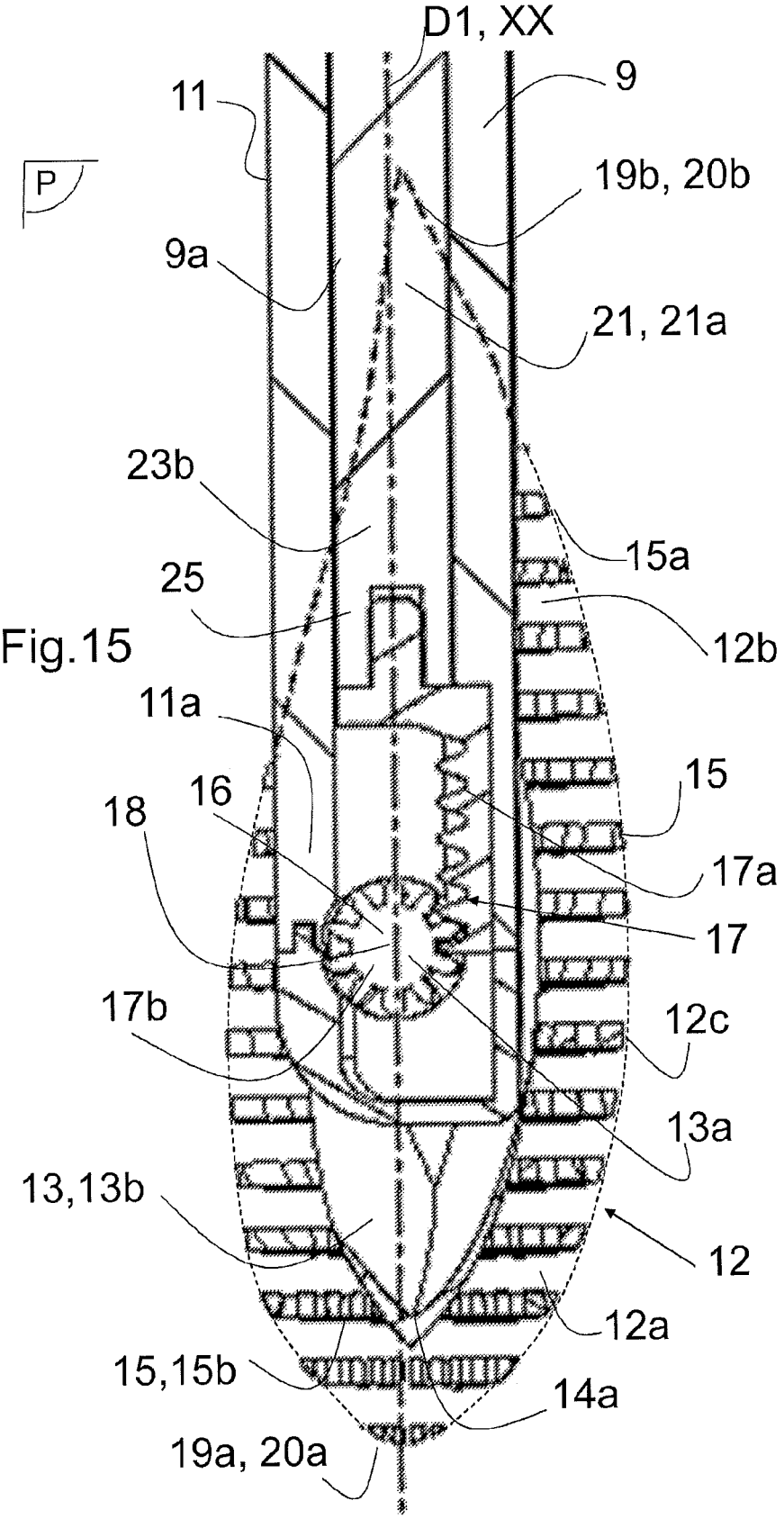
Figure 16:
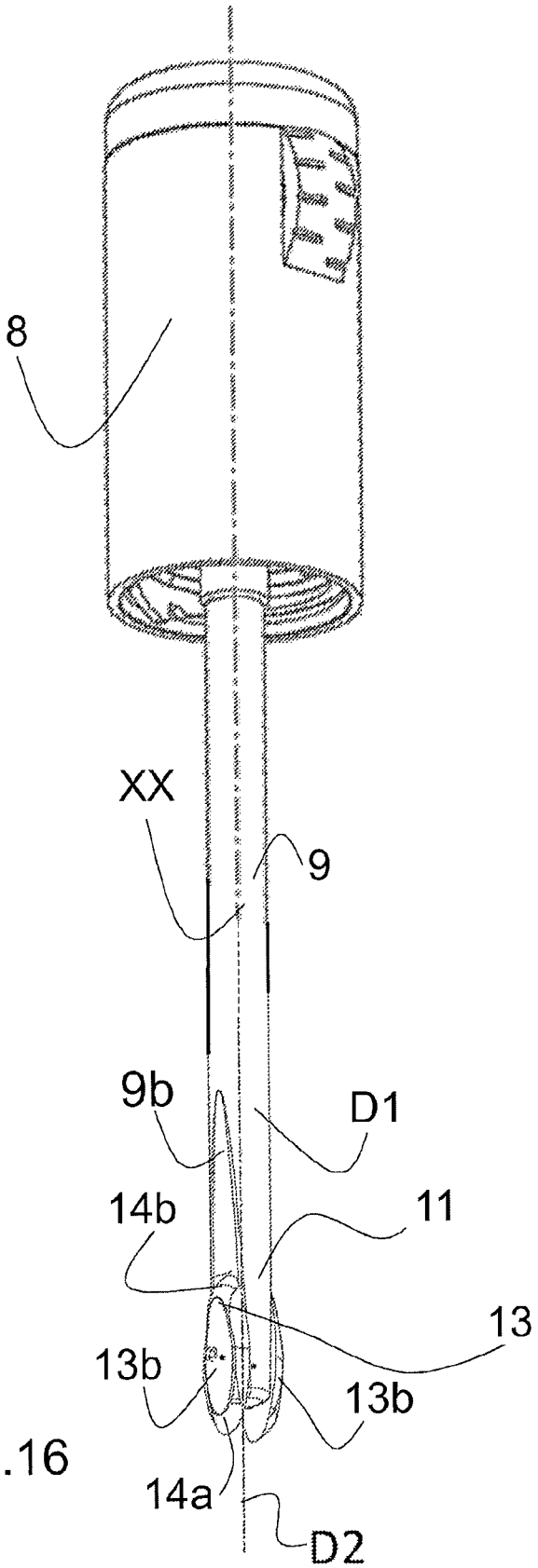
Figure 17:
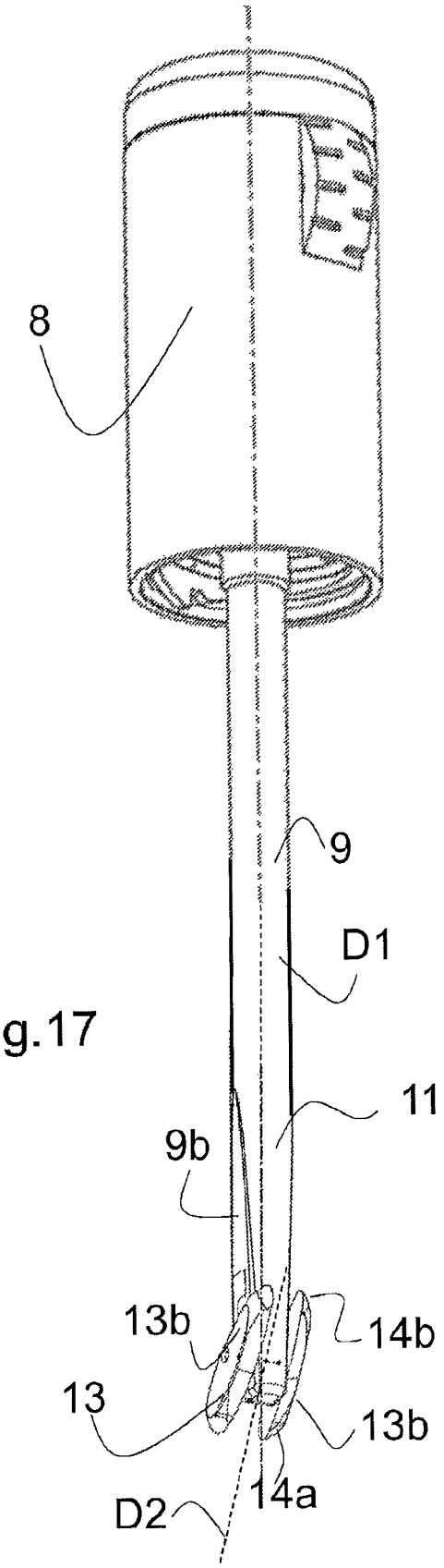
Figure 18:
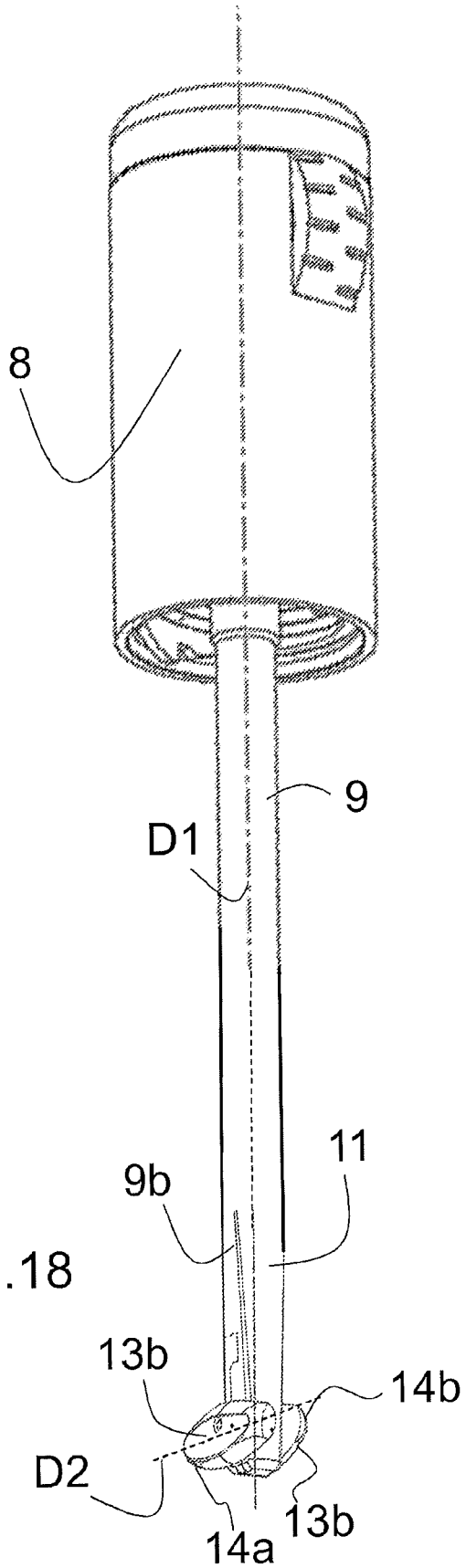

FIG. 15 is a partial view on a larger scale, in cross-section along the pivot plane.

FIGS. 16, 17, 18 and 19 are four partial views in perspective of the application device, illustrating the configuration of the support member in different positions.

A disclosure of the several embodiments shall be exposed below while referring to the figures.

The invention relates to an assembly 1 comprising a reservoir 2, provided with one opening 3, forming an internal cavity 2*a*, suitable and intended to receive cosmetic products, such as mascara, or another product equivalent with regard to ergonomic conditions, and an application device 4, suitable to be associated with the reservoir 2 when the assembly 1 is not used or separated from it to use the application device 4 by applying it onto keratin fibres, such as eyelashes and eyebrows to deposit mascara thereon. The cosmetic product is sometimes later referred to as "contents", by ellipsis.

An "application device" means a structural and functional entity that can be handled by a user with the hand by a handling portion and that is provided with an application portion having application members—such as hairs, tips, fibres, spongy elements—so that these application members can be filled with mascara from a reservoir and applied, generally by being moved, onto keratin fibres to deposit mascara, and if necessary produce an effect.

The reservoir 2 behaves as an assembly, being rigid (which includes substantially rigid). It may have a general cylindrical shape with a circular or pseudo-circular guide curve and a rectilinear or pseudo-rectilinear generator, for example in the general shape of a tube, with the opening 3 formed at the end of a narrowed diameter neck 3*a*, associated with the main portion 2*b* of the reservoir 2 by a shoulder 3*b*.

The internal cavity 2*a* of the reservoir 2 can be limited, on one end by a more or less flat bottom 5, on the other end by the shoulder 3*b* and the neck 3*a*, and laterally by a peripheral side wall 6 having an inner face 6*a* in contact with the contents.

The reservoir 2 has a single opening 3 with a circular or pseudo-circular contour, which is used for the passage of the application device 4, in both directions, inwards (introduction) and outwards (extraction) of the reservoir 2, by simply sliding along the axis XX. It can have a wiper 7 associated with the opening 3, for example at the neck 3*a*.

In the case of mascara, the reservoir 2 can have a capacity of about 1 ml to 15 ml, an axial height of less than 1 cm to 15 cm and an external diameter of about 5 ml to 20 ml. Such a reservoir 2 can be transparent, translucent, opaque. It can be made of plastic material, glass or metal While the application device 4 has a different shape and structure from those known, the invention allows a known per se and classic reservoir for a mascara and its introduction into, or extraction from, the reservoir by simply sliding along the axis XX, according to a known per se and classic gesture.

When not in use, the set 1 can be placed with its axis XX vertical, resting on its bottom 5, with the opening 3 and the neck 3*a* being placed higher (FIGS. 8 to 10).

The reservoir 2 may be embodied in other ways than those described.

The invention relates to the set 1 the cavity 2*a* of which is filled with the contents, and the set 1 the cavity 2*a* of which has no contents. The invention also relates to the mounted assembly 1, the application device 4 being physically associated with the reservoir 2, and the dismounted assembly 1, with the application device 4 being physically separated from the reservoir 2. The invention also relates to the application device 4 itself, and as far as it is intended to be physically and functionally associated with the reservoir 2.

The application device 4 includes a terminal handling cap 8, that terminates the application device 4 on one side. The cap 8 is used to close the reservoir 2. It is also a means for holding, moving and manoeuvring the application device 4 with the user's hand. These are its functions, with the cap 8 possibly being embodied in many ways. For example, the cap 8 may have a shape similar to that of the reservoir 2 with a cylindrical shape having a circular or pseudo-circular guide curve and a rectilinear or pseudo-rectilinear generator.

The cap 8 has a peripheral skirt 8*a* and a transverse vertex 8*b* on the side. Towards the opposite of the transverse vertex 8*b*, the peripheral skirt 8*a* is extended by an extension of skirt 8*c* provided towards its inner face with means for the removable association of the cap 8 to the neck 3*a* (screw threads, pins), complementary to means of association provided on the neck 3*a*. This skirt extension 8*c* laterally surrounds the neck 3*a*. Like the reservoir 2, the handling cap 8 has an axis that is referenced XX.

The handling cap 8 can have a cavity 8*d* inside which axially extends along the axis XX and also radially to and from the axis XX. This cavity 8*d* leads to the peripheral skirt 8*a* through a hole 8*e* which is elongated in the axial direction XX. This cavity 8*d* has on the axis XX side a terminal cavity 8*f* (FIG. 9).

The application device 4 consists of a second part 9, called the rod portion 9, which is elongated and thin, justifying the term "rod". It has an overall rigidity and a main direction D1, rectilinear in the represented embodiment.

The rod portion 9 has a first end 10 where it is rigidly associated with the handling cap 8, for example in its median inner part, so as to form a one-piece assembly. For example, the handling cap 8 has a transverse wall 8*g* inside, between the peripheral skirt 8*a* and the skirt extension 8*c* which has the function of closing the opening 4 and rigidly carrying the rod portion 9 by its first end 10, for example by welding. Or the handling cap 8 and the rod portion 9 form a single-piece unit. The rod portion 9 has a second terminal section 11 including a second end portion 11*a* which terminates it.

The rod portion 9 has an axial channel 9*a*, opening at both ends, namely the first end 10 and the second end portion 11*a*. On the first end 10 side, the channel 9*a* opens into the terminal recess 8*f* of the handling cap 8.

Thirdly, the application device 4 consists of a portion 12, called mascara application portion 12, or by ellipsis, an application portion 12. The application portion 12 is elongated and extends along a straight or possibly slightly curved main axis D2. The application portion 12 includes a support member 13, also elongated along the main axis D2, and having two ends 14*a* and 14*b*. This support member 13 is rigid (which must be understood as having a certain overall rigidity) and is equipped and furnished with radial application members 15 on its periphery. These application members 15 are qualified as radial insofar as they extend in a general globally radial direction perpendicular to the main axis D2. These application members 15 are arranged on the lateral periphery of the support member 13, around the main axis D2. The functions of these application members 15 are to be loaded with some contents from the reservoir 2 and to be applied, generally by being moved, onto the support where the contents is to be applied. These application members 15 can be the subject of a number of embodiments. They can be in the form of hairs, tips, fibres, spongy elements.

The application portion 12 is associated with the rod portion 9 at its second end portion 11*a*, so as to than a single-piece unit therewith. Due to the length of the rod portion 9 in the main direction D1, the application portion 12 is moved away from the handling cap 8.

The dimensions of the application device 4 are related to the dimensions of the reservoir 2. The rod portion 9 and the application portion 12 must be able to pass through the opening 3 in cooperation with the wiper 7. When the application device 4 is mounted assembled on the reservoir 2, the application portion 12 is located near the bottom 5 and the handling cap 8 around the neck 3*a*.

Figure 5:
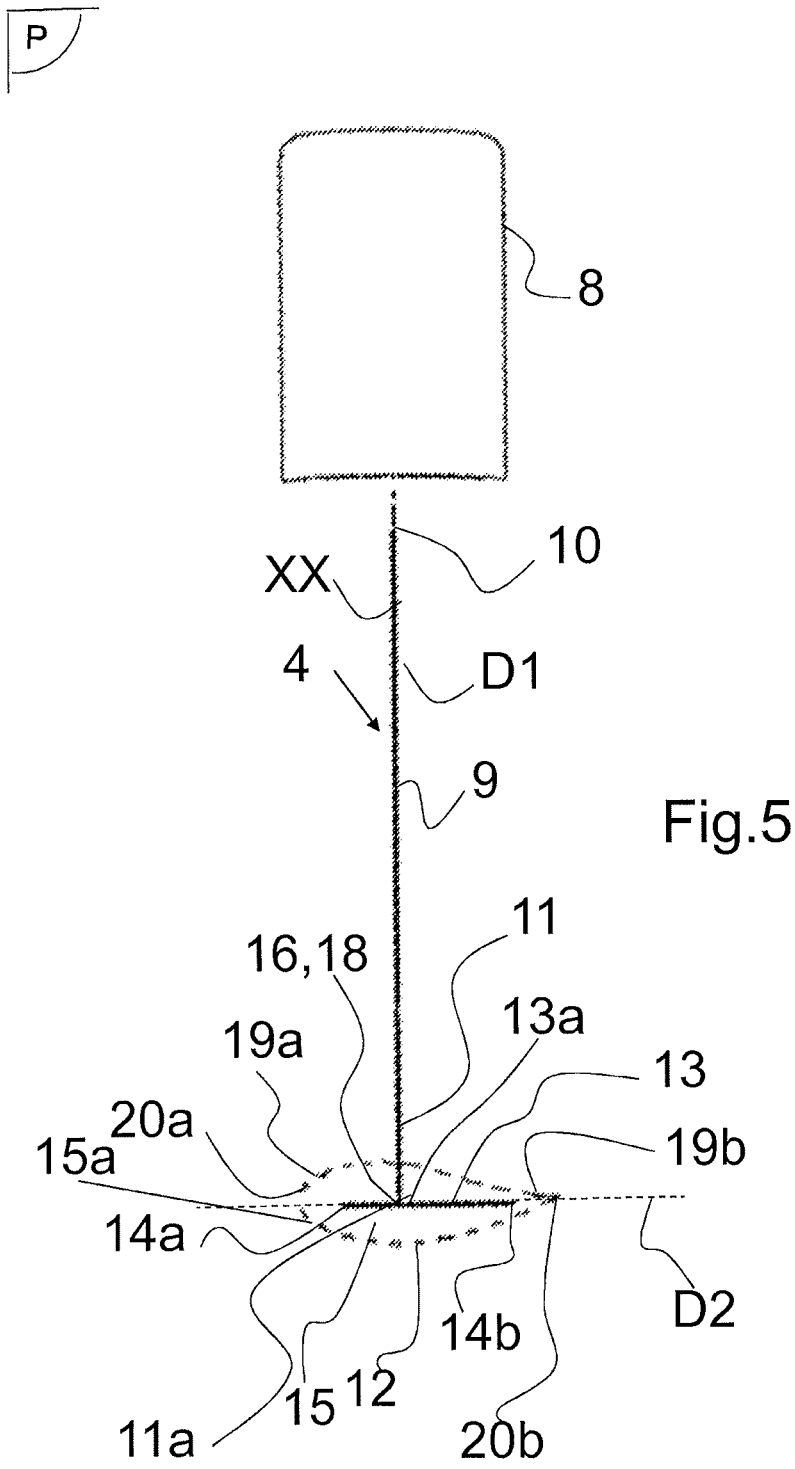
FIG. 5 is a simplified diagram corresponding to FIG. 4, symbolically illustrating, on the one hand, the support member at both ends of the application portion intended to be provided, at its periphery with radial application members and, on the other hand, the application portion.
Figure 6:
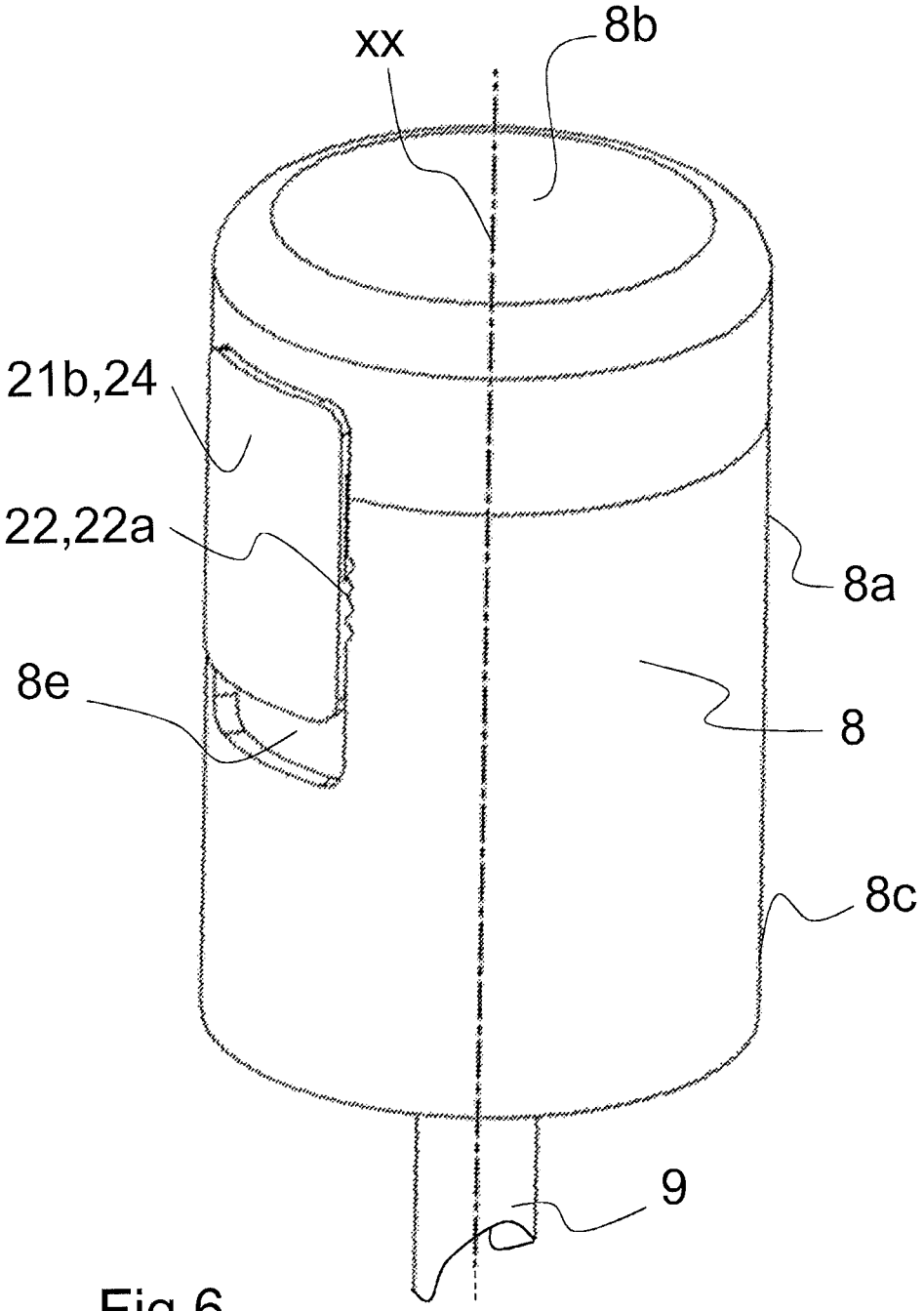
FIG. 6 is a partial view of FIG. 1 on a larger scale, showing the handling cap with its hole, the control knob and additional blocking reliefs allowing reciprocal blocking in several positions.

The application portion 4 is mounted hinged in an articulation zone 16 and by articulation means 17 on the rod portion 9 at its second end portion 11*a*, about a pivot axis 18, orthogonal to a main radial pivot plane P defined by the axis D2 and the direction D1 (plane in FIG. 5). Q is a radial reference plane of travel, orthogonal to the pivot plane P (plane of FIG. 9). Instead of a perfect pivot axis, it can be a pivot zone around an axis.

With this hinge mounting, the application portion 4 can occupy a centered position in which the axis D2 and the direction D1 are coaxial (which also includes substantially coaxial), an extreme inclined position in which said axis D2 and said direction D1 are inclined with respect to each other at most, and any intermediate inclined position. With this assembly, the application portion 4 can be pivoted from one position to the other, centred and extreme inclined, or intermediate inclined position, and vice versa, by means of a pivoting stroke around the axis 18. FIGS. 2 to 5, 8 to 14 and 16 to 19 illustrate the various, i.e. centred, extreme inclined and intermediate inclined positions.

Figure 7:
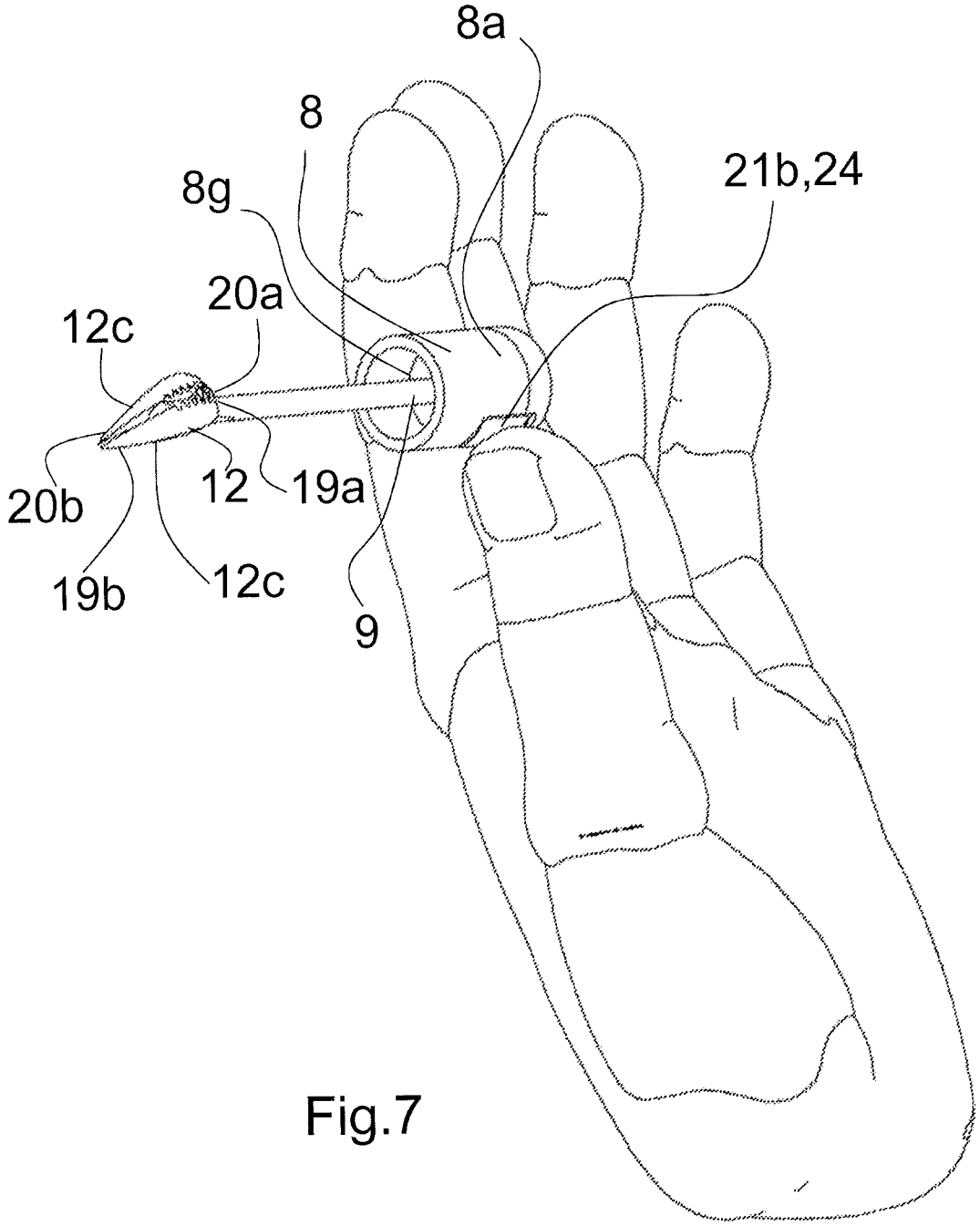
FIG. 7 is a perspective view of the application device in the hand of a user, whose thumb can slide the control knob.

According to the embodiments, the pivot stroke of the application portion 12 between the centred and the extreme inclined positions is between 45° and 135°, more particularly around 90° (FIG. 4, 13) or 135° (FIGS. 7, 14).

The articulation zone 16, the articulation means 17 and the pivot axis 18 are located in a median section 13*a* of the support member 13, being spaced from each one of its both ends 14*a* and 14*b*, so as not to be present there. The term "means" applied to the section 13*a* must be understood as referring to a support zone 13 that is spaced, in particular substantially apart, from both ends 14*a* and 14*b* of the support 13 (FIG. 5). On the other hand, the term "means" should not be understood as referring to a zone necessarily located at an equal distance from either end 14*a* and 14*b*.

In a possible embodiment (see drawings), the articulation zone 16, the articulation means 17 and the pivot axis 18 are located away from the mid-point of the support member 13 by being spaced apart from the two ends 14*a* and 14*b* by different distances, with on one side a section of shorter length and on the other side a section of longer length, the length ratio being of the order of 1.5 to 2.5 and in particular equal to or of the order of 2. In another possible embodiment, the articulation zone 16, the articulation means 17 and the pivot axis 18 are located in a central position on the support member 13, being spaced from both ends 14*a* and 14*b* by a similar distance.

The application portion 12 has two real sections 12*a* and 12*b*: a first section 12*a* between the pivot axis 18 and a first end 19*a* of the application portion 12 and a second section 12*b* between the pivot axis 18 and a second end 19*b* of the application portion 12. The first section 12*a* and the second section 12*b* are mutually extended, i.e. coaxial (which also includes substantially coaxial).

The second end portion 11*a* of the rod portion 9 is located between the two sections 12*a* and 12*b*, as is especially visible in FIGS. 4, 7 and 16 to 19.

With the application device 4 in the centered position (FIGS. 2, 8, 11, 15, 16), one of the two sections 12*a*, 12*b* can be qualified as distal and the other as proximal. The terms "distal" and "proximal" refer to the distance between the handling cap 8 or the first end 10 of the rod portion 9 and the end 19*a*, 19*b* of the application portion 12. Distal applies to the longest distance and proximal to the shortest distance. In this case, the first section 12*a* is distal and the second section 12*b* is proximal. The first distal section 12*a* is arranged in the axial extension of the rod portion 9, beyond its second end portion 11*a*, while the second proximal section 12*b* is located at the level of the second end section 11 of the rod portion 9.

The first distal section 12*a* and the second proximal section 12*b* extend transversely on either side of the rod portion 9, i.e. on either side of the travel reference plane Q.

The two ends 14*a* and 14*b* of the support member 13 are included in the outer shell 15*a* of the application members 15, which means that the two ends 14*a* and 14*b* are not exposed and prominent, but protected by application members located at these locations. The application members 15 also extend axially beyond each of the two ends 14*a* and 14*b*. This means that some application members 15 have an axial direction (direction of the axis D2) or that all the application members 15 extend in the axial direction. More generally, the support member 13, including its two ends 14*a* and 14*b*, is entirely included in the outer shell 15*a*, i. e. entirely spaced towards the inside of the outer shell 15*a*. In doing so, neither end 14*a* nor 14*b* of the support member 13 is likely to be hurtful or to come into contact with the support which the content is applied on.

The outer shell 15*a* of the application devices 15 has an ellipsoidal assembly shape elongated along the axis D2. It is more particularly an ovoid assembly shape with on one side a part with a larger radius of curvature 20*a* and on the opposite side a part with a smaller radius of curvature 20*b*. For example, the ratio between the dimension of the major axis and the dimension of the minor axis of the outer shell 15*a* is between 2 and 4, in particular is equal to or close to 3. The radius of curvature of the part with the larger radius of curvature 20*a* can be between 0.5 mm and 50 mm. As for the part with a smaller radius of curvature 20*b*, it can form a rounded tip at its apex.

FIGS. 2, 8 and 9 illustrate one embodiment in which the part with a larger radius of curvature 20*a* belongs to the first distal section 12*a*, while the part with a smaller radius of curvature 20*b* belongs to the second proximal section 12*b*, which is advantageous for loading the application portion with mascara and using the wiper 7 while avoiding a piling of contents at the part with a smaller radius of curvature 20*b*. In this construction, the support member 13 has on one side a section of shorter length and on the other side a section of longer length, the section of shorter length is located on the side of the part with the larger radius of curvature 20*a* and the section of longer length is located on the side of the part with the smaller radius of curvature 20*b*. Thus, the articulation area 16, the articulation means 17 and the pivot axis 18 are located away from the mid-point of the support member 13, being spaced apart at both ends 14*a* and 14*b* by different distances, with a section of shorter length on one side and a section of longer length on the other. For example, the ratio between the length of the longer and shorter sections is of the order of 1.5 to 2.5, in particular equal to or of the order of 2.

The application portion 12 is formed by two application sub-portions 12*c*, the support member 13 being formed by two support sub-portions 13*b*, and two sub-portions of application members 15*b* being provided. The two application sub-portions 12*c* of the application portion 12 are similar and adjacent.

The two application sub-portions 12*c* are arranged opposite each other and symmetrically with respect to the pivot plane P. They occupy the same relative angular position. They rotate in synchronism.

The two support sub-members 13*b* of the support element 13 are similar Each support sub-member 13*b* is rigid (i.e. has a certain overall rigidity). It is elongated along a straight axis. The two support sub-members 13*b* are arranged opposite and close to each other and symmetrically with respect to the pivot plane P, with interposition between them of the second end portion 11*a* of the rod portion 9 and the articulation means 17. The two support sub-members 13*b* occupy the same relative angular position. They rotate in synchronism.

In addition, two subsets of application members 15*b* are provided for, respectively for the two support sub-members 13*b*, their arrangement conferring continuity towards the outside (i.e. towards the shell 15*a*) between the two subsets of application members 15*b*. From the outside, the user does not or hardly see(s) or feel(s) that the application portion 12 is formed by two application sub-portions 12*c*.

This structure and arrangement make it possible to hide the second end portion 11*a* of the rod portion 9 and the articulation means 17 which are included between the two support sub-members 13*b* and entirely in the shell 15*a* of the application members 15. In addition, the second end portion 11*a* of the rod portion 9 and the articulation means 17 are not likely to be hurtful or to come into contact with the support which the contents is applied on.

Each of the two application sub-portions 12*c* and each of the two support sub-portions 13*b* has, respectively, a shape of a semi ellipsoidal assembly cut in the direction of the major axis, more particularly a semi-oval assembly shape with on one side a part with a larger radius of curvature and on the opposite side a part with a smaller radius of curvature, in particular forming a rounded tip at its apex. The combination of these two ellipsoidal halves, more particularly two semi-ovoids, makes it possible to confer on the outer shell 15*a* of the two subsets of application organs 15*b* the ellipsoidal assembly shape, more particularly ovoid, previously described. In the centred position, the respective portions of the two sub-assemblies of application devices 15*b* towards the part with a larger radius of curvature 20*a* are intertwined.

Each of the two application sub-portions 12*c* is limited on the second end portion 11*a* side by a generally flat shell face extending in the general direction of and in the vicinity of the pivot plane P. Similarly, each of the two support sub-members 13*b* is limited on the second end portion 11*a* side by a generally flat shell face extending in the general direction of the pivot plane P, in the vicinity of this plane, and adjacent to the second end portion 11*a* (see FIGS. 15 to 19). And the two faces limiting the two application sub-portions 12*c* and the two support sub-members 13*b* towards the second end portion 11*a* are spaced from each other in the direction of the pivot axis 18 of the application portion 12.

If necessary, the rod portion 9 may include in its second terminal section 11 two bevelled sides 9*b*, allowing the movement of the application sub-portions 12*c* and preventing the two support sub-portions 13*b* from interfering with the rod portion 9 by their generally flat shell faces mentioned above.

Figure 19:
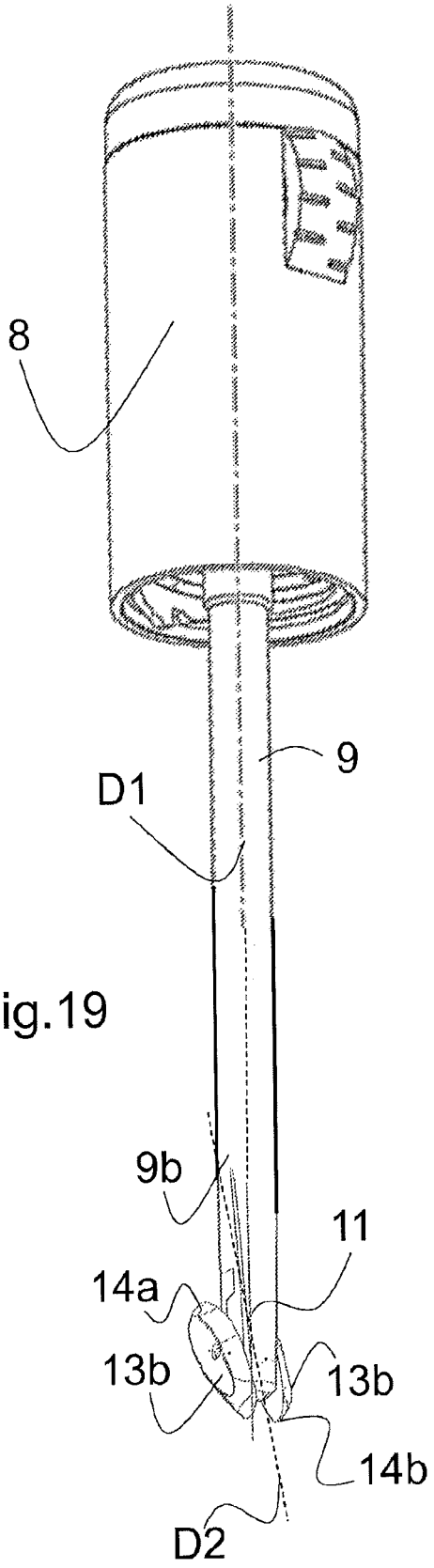

FIGS. 2, 8, 11, 11, 15 and 16 illustrate the application device 4 in the centered position where the two application sub-portions 12*c* of the first distal section 12*a* are adjacent to each other, while the two application sub-portions 12*c* of the second proximal section 12*b* are spaced from each other with interposition between them of the second terminal section 11 of the rod portion 9. FIGS. 7 and 19 illustrate the application device 4 in the extreme inclined position where the two application sub-portions 12*c* of the second proximal section 12*b* are adjacent to each other.

The articulation means 17 are arranged so that when pivoting the application portion 12 between the centred position and the extreme inclined position, the two application sub-portions 12*c* move relative to each other, away for the first distal section 12*a*, and closer for the second proximal section 12*b*. In another embodiment, the articulation means 17 are arranged in such a way that during such pivoting, the two application sub-portions 12*c* do not move relative to each other.

The articulation means 17 (FIG. 15) may comprise a rack 17*a* arranged on the second end portion 11*a* of the rod portion 9, so as to extend in the direction of the rod portion 9 and at least one toothed wheel 17*b* cooperating with the rack 17*a*, carried so as to be pivotable by the support member 13 of the application portion 12, the toothed wheel 17*b* and the rack 17*a* being arranged so as to be permanently engaged. The articulation means may include end stops corresponding to the centred position and the extreme inclined position.

With two support sub-members 13*b*, two toothed wheels 17*b* are provided, supported so as to be pivotable by the two support sub-members, respectively, each toothed wheel 17*b* being located on the shell face of each support sub-member 13*b* located on the side of the second end portion 11*b* of the rod portion 9.

The application device 12 may include and incorporate means 21 to control the pivoting of the application portion 12 which may include locking, braking or friction means 22 capable of maintaining the application portion 12 in an intermediate position between the centred position and the extreme inclined position, in the absence of sufficient unlocking stress. Such locking, braking or friction means 22 may be provided or may include projections or stops 22*a* or friction between associated parts and in relative movement.

In the embodiment shown, the means 21 for controlling the pivoting of the application portion include a rod 21*a* and a control knob 21*b*. The small rod 21*a* is elongated and thin. It has an overall rigidity with D1 as the main direction D1. It is straight. It has a first end 23*a* where it is rigidly associated with the control knob 21*b*. It has a second end 23*b* where it is rigidly associated with the corresponding end 25 of the rack 17*a*, for example by welding. According to another embodiment, the rod 21*a* and the rack 17*a* form a one-piece assembly. The rod 21*a* is placed in a recess in the rod portion 9, here the channel 9*a*. It is arranged so that it can slide in the direction D1 of the rod portion 9, over a certain stroke, in both directions and to transmit the sliding movement from its first end 23*a* to its second end 23*b*. On the side of the first end 10 of the rod portion 9 where the channel 9*a* opens into the terminal recess 8*f* provided in the handling cap 8, the first end 23*a* of the rod 21*a* enters the terminal recess 8*f*, which allows it to be rigidly associated with the control knob 21*b*.

The control knob 21*b* has a shape complementary to that of the cavity 8*d* while being slidable therein in the direction of the axis XX, over a certain stroke, in both directions, the axial dimension of the cavity 8*d* (and of the hole 8*e* being greater than the axial dimension of the control knob 21*b*, the difference between these two dimensions corresponding to the maximum stroke of the control knob 21*b*. The control knob 21*b* can therefore come to rest on either of the two transverse faces 26 of the cavity 8*d*. On the other hand, the control knob 21*b* can slide axially in the direction of the axis XX, if necessary with some slight friction, on both pseudo-radial faces 27 of the cavity 8*d*. The control knob 21*b* is accessible to the user at the location of the hole 8*e*. It has a handling part 24 which forms its outer end. The control knob 21*b* and especially the handling portion 24 thereof can thus be moved into the hole 8*e*. The control knob 21*b* can therefore be operated with a finger of the hand carrying the handling cap 8, such as the thumb. The control knob 21*b* also extends radially towards and up to the axis XX so that it is housed on the side of its inner end in the terminal recess 8*f* and comes axially, in the direction of the axis XX, at the outlet of the channel 4*a* and thus at the first end 23*a* of the small rod 21*a*. Thus, the small rod 21*a* can be rigidly associated with the control knob 21*b*, laterally.

Any projections or stops 22*a* can be provided on the edge of the hole 8*e* and on the adjacent edge of the handling portion 24 of the control knob 21*b*. Any friction of the blocking and braking means 22 can occur between the rod 21*a* and the inner side of the channel 4*a* or between the control knob 21*b* and the pseudo-radial sides 27 of the cavity 8*d*.

The method for implementing the set 1 is as follows, with reference to the case where we start from a state in which the application device 4 is dissociated from the reservoir 2. The application device 4 is operated through the handling cap 8, which includes the control knob 21*b*. The method comprises the following steps of:

- bringing the application device 4 into the centred position if it is not already centred,
- introducing into the reservoir 2, through its opening 3, at least the application portion 12 of the application device 4 into the centred position, and loading it with mascara,
- extracting from the reservoir 2, through its opening 3, the application portion 12 loaded with mascara,
- bringing the application device 4 into an inclined position suitable for the application,
- applying the application agents 15 onto keratin fibres (eyelashes, eyebrows).

Possibly, the mascara-loaded application portion 12 is extracted from the reservoir 2 through its opening 3 while in the centred position and the application device 4 is brought into an inclined position suitable for the intended application once it has been completely extracted from the reservoir 2.

Possibly, the application device 4 is brought into a suitable inclined position before applying the application devices 15 onto keratin fibres and/or the application device 4 is brought into a suitable inclined position with the only hand carrying the handling cap 8 and/or the application device 4 is brought into the centred position before it is introduced into the reservoir 2.

Possibly, (FIG. 10), while the application portion 12 is in the reservoir 2, the application device 4 is brought into an inclined position to be loaded with mascara located on the inner face 6*a* of the side wall 6 of reservoir 2, then brought into the centered position to be extracted from the reservoir 2. This constructive arrangement makes it possible to effectively recover the mascara that may have been deposited on the inner face 6*a* of the side wall 6 of the reservoir 2

The invention claimed is:

1. An application device for applying a cosmetic product associated with a reservoir, the application device comprising:

- a terminal handling cap forming a suitable cap intended to close said reservoir and means for holding, moving and maneuvering the application device;
- an elongated rod portion, having a main direction, a first end associated with the handling cap and a second end portion including a second end portion that terminates the application device; and
- an elongated application portion extending along a main axis and comprising a support member having two ends and radial application members arranged at a periphery of the support member, the application portion being hingedly mounted in an articulation zone by articulation means on the rod portion at the second end portion and about a pivot axis orthogonal to a main radial pivot plane defined by the pivot axis of the application portion and the main direction of the rod portion, to thereby allow the application portion to be pivoted by a pivoting stroke between a centered position in which the pivot axis of the application portion and the main direction of the rod portion are coaxial and an extreme inclined position in which said pivot axis and said main direction are inclined with respect to each other, wherein:

- the articulation zone, the articulation means and the pivot axis are located in a median section of the support member, spaced from each of the two ends, the application portion is formed by two adjacent similar application sub-portions arranged opposite each other with respect to the pivot plane, and the support member is formed by two similar support sub-members, arranged opposite and close to each other with respect to the pivot plane with interposition between them of the second end portion of the rod portion and the articulation means.

2. The application device according to claim 1, wherein both ends of the support member are included in the outer shell of the application members and undiscovered and prominent, the application members extending axially beyond each of these two ends, and the support member is entirely included in the outer shell and is entirely spaced inwardly from the outer shell.

3. The application device according to claim 1, wherein the outer shell of the application members has an ellipsoidal and ovoid assembly shape elongated in the axis of the application portion, with on one side a part with a greater radius of curvature and on the opposite side a part with a smaller radius of curvature, wherein the part with a larger radius of curvature belongs to a first distal section of the application portion and the part with a smaller radius of curvature belongs to a second proximal section of the application portion.

4. The application device according to claim 1, wherein:

the application portion is formed by two application sub-portions which are arranged symmetrically with respect to the pivot plane and which occupy the same relative angular position and rotate in synchronism, the support member is formed by two support sub-members which are arranged symmetrically with respect to the pivot plane and which occupy the same relative angular position and rotate in synchronism, and the application members comprise two subsets of application members, respectively for the two support sub-members, the arrangement of the application members conferring outward continuity between the two subsets of application members.

5. The application device according to claim 4, wherein:

each of the two application sub-portions and each of the two support sub-members has, respectively, a semi-oval assembly shape cut in the direction of a main axis with a first part having a greater radius of curvature on a first side and a second part with a smaller radius of curvature on a second side opposite the first side and forming a rounded tip at an apex of the semi-oval assembly shape, each of the two application sub-portions is limited on the side of the second end portion of the rod portion by a generally flat shell face which extends in the general direction of the pivot plane and in the vicinity of this plane, each of the two support sub-members is limited on the side of the second end portion of the rod portion by a generally flat shell face which extends in the general direction of the pivot plane, in the vicinity of this plane, and which is adjacent to the second end portion of the rod portion.

6. The application device according to claim 4, wherein:

in the centered position, the two application sub-portions of the first distal section are adjacent to each other, while the two application sub-portions of the second proximal section are spaced from each other with interposition between them of the second terminal section of the rod portion, in an extreme inclined position, the two application sub-portions of the proximal second section are adjacent to each other, the articulation means are arranged such that when the application portion is pivoted between the centered position and the extreme inclined position, the two application sub-portions move relative to each other, away for the first distal section and closer for the second proximal section.

7. The application device according to claim 1, wherein the pivoting stroke of the application portion between the centered and extreme inclined positions is between 45° and 135°.

8. The application device according to claim 1, wherein the articulation zone, the articulation means and the pivot axis are located away from the mid-point of the support member by being spaced from each of the two ends of the support member by different distances, with on one side a section of shorter length and on the other a section of longer length, the ratio between the length of the longer section and the length of the shorter section being of the order of 1.5 to 2.5, the shorter section being located on the side of the part with the greater radius of curvature of the outer shell of the application members and the longer section being located on the side of the part with the smaller radius of curvature of the outer shell of the application members.

9. The application device according to claim 1, wherein the articulation means comprises a rack arranged on the second end portion of the rod portion, so as to extend in the direction of the rod portion and at least one toothed wheel cooperating with the rack, carried so as to be pivotable by the support member of the application portion, the toothed wheel and the rack being arranged so as to be in permanent engagement, the application device further comprising and integrating means for controlling the pivoting of the application portion comprising a rod disposed in a recess provided in the rod portion and arranged so as to be slidable in the direction of the rod portion and a control knob attached to a first end of the rod, disposed so as to be accessible from the outside through a hole provided in the side skirt of the handling cap.

10. An assembly comprising:

a reservoir provided with an opening suitable and intended to receive cosmetic products; and the application device suitable to be associated with or dissociated from the reservoir, according to claim 1.

11. A method for operating the assembly according to claim 10, starting from a state in which the application device is dissociated from the reservoir, and handling the application device through the handling cap, the method comprising:

bringing the application device into the centered position if not already centered, introducing into the reservoir, through the reservoir opening, at least the application portion of the application device in the centered position, and loading the reservoir with mascara, extracting from the reservoir, through the reservoir opening, the application portion loaded with mascara, bringing the application device into an inclined position suitable for the application, applying the application members onto keratin fibres (eyelashes, eyebrows).

12. The method according to claim 11, wherein the mascara-loaded application portion is extracted from the reservoir through the reservoir opening while the mascara-loaded application portion is in the centered position and the application device is brought into an inclined position suitable for the intended application once the mascara-loaded application portion has been completely extracted from the reservoir.

13. The method according to claim 12, wherein while the application portion is in the reservoir, the application device is brought into an inclined position to be loaded with mascara located on the inner side of the side wall of the reservoir, then brought into the centered position to be extracted from the reservoir.

14. The application device according to claim 1, wherein the cosmetic product is mascara.

15. The application device according to claim 1, wherein the radial application members comprise at least one selected from hairs, tips, fibers and sponge elements.

16. The application device according to claim 8, wherein the shorter section is equal to or of the order of 2.

* * * * *